US008635832B2

(12) United States Patent
Heudorfer et al.

(10) Patent No.: US 8,635,832 B2
(45) Date of Patent: Jan. 28, 2014

(54) MOUNTING RAIL

(75) Inventors: Markus Heudorfer, Lustenau (AT); Bernhard Sander, Munich (DE); Holger Basche, Meiningen (AT); Denis Novokshanov, Aachen (DE); Bernhard Winkler, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 13/695,223

(22) PCT Filed: Jan. 12, 2011

(86) PCT No.: PCT/EP2011/050317

§ 371 (c)(1),
(2), (4) Date: Feb. 26, 2013

(87) PCT Pub. No.: WO2011/134680

PCT Pub. Date: Nov. 3, 2011

(65) Prior Publication Data

US 2013/0145720 A1 Jun. 13, 2013

(30) Foreign Application Priority Data

Apr. 29, 2010 (DE) ..... 10 2010 028 349

(51) Int. Cl.
*E04B 1/41* (2006.01)

(52) U.S. Cl.
USPC ..... 52/704

(58) Field of Classification Search
USPC ..... 52/707, 704, 710, 711
See application file for complete search history.

(56) References Cited

U.S. PATENT DOCUMENTS

| | | | | | |
|---|---|---|---|---|---|
| 1,093,426 | A | * | 4/1914 | Irwin | 256/51 |
| 1,260,331 | A | * | 3/1918 | Collings | 52/699 |
| 1,484,053 | A | * | 2/1924 | Bayley | 52/704 |
| 1,539,219 | A | * | 5/1925 | Taseff | 52/706 |
| 1,710,422 | A | * | 4/1929 | Kehm | 52/711 |
| 2,629,467 | A | | 2/1953 | Fry et al. | |
| 2,909,054 | A | * | 10/1959 | Phillips | 52/710 |
| 3,156,450 | A | * | 11/1964 | Thom | 52/707 |
| 3,561,307 | A | * | 2/1971 | Mortensen | 411/432 |
| 4,028,857 | A | * | 6/1977 | Fischer | 52/309.2 |
| 4,044,512 | A | * | 8/1977 | Fischer et al. | 52/127.4 |
| 4,700,923 | A | | 10/1987 | Lewis, Jr. et al. | |
| 5,669,199 | A | * | 9/1997 | Ludwig et al. | 52/704 |
| 5,729,951 | A | * | 3/1998 | Frohlich | 52/698 |

(Continued)

FOREIGN PATENT DOCUMENTS

| | | |
|---|---|---|
| DE | 26 02 164 | 8/1977 |
| DE | 35 31 998 A1 | 3/1987 |
| DE | 101 25 970 | 12/2002 |
| DE | 20 2009 012533 U1 | 2/2010 |

*Primary Examiner* — Christine T Cajilig
(74) *Attorney, Agent, or Firm* — Davidson, Davidson & Kappel, LLC

(57) ABSTRACT

In an installation channel to be embedded into a curable construction material, e.g. concrete, having a support profile and preferably an attachment for attaching at least one add-on part to the installation channel, so that the outside of the support profile has a direct connection to the curable construction material at an embedding area, a potential fault block should be large so that large forces can be absorbed by the installation channel.

A compressible insert is fastened to the outside of the support profile at the embedding area, so that part of the outside of the support profile is not in direct contact with the curable construction material at the embedding area.

29 Claims, 5 Drawing Sheets

(56) References Cited

U.S. PATENT DOCUMENTS

| | | | | |
|---|---|---|---|---|
| 6,240,697 | B1 * | 6/2001 | Thompson et al. | 52/698 |
| 6,272,806 | B1 * | 8/2001 | Face, III | 52/396.04 |
| 6,393,795 | B1 * | 5/2002 | Irwin et al. | 52/698 |
| 8,365,484 | B2 * | 2/2013 | Foley | 52/289 |
| 2010/0170185 | A1 * | 7/2010 | Birnbaum et al. | 52/699 |
| 2011/0283654 | A1 * | 11/2011 | Pol et al. | 52/710 |

* cited by examiner

MOUNTING RAIL

The present invention relates to an installation channel to a method for embedding an installation channel, and to a structure.

BACKGROUND

In construction engineering, anchor channels or installation channels are cast or embedded into concrete so that only a top or outer area of a support profile of the installation channel remains freely accessible. Through contact with or connection to the surrounding concrete, the installation channel conveys the applied forces into the concrete. Here, the installation channel generally has anchors at the rear. In general, the anchors essentially convey centrally acting forces into the concrete. Transverse forces that act on the anchor channel are conveyed into the concrete by lateral legs of the support profile of the installation channel. Under large transverse forces, fissures occur, consequently leading to a fault block in the concrete. The fissures propagate in the concrete at various angles, whereby, as a function of the angle, the volume of the broken-out fault block increases, and so does the associated pull-out force. Thus, upon exposure to transverse forces, the installation channel fails relatively soon due to a flat fissure or a small fault block.

German patent application DE 101 25 970 A1 discloses an installation channel having two half-channels running in the lengthwise direction that are connected to each other. The half-channels are connected here by means of connectors, whereby the connectors are preferably configured as clamp connectors. The installation channel is intended to be embedded into concrete in a ceiling or wall of a building.

German patent application DE 35 31 998 A1 discloses an anchor channel that can be embedded into concrete, that has a cross section configured as a C-profile, and that has anchors projecting from the rear of the channel that are in the form of bolts provided with threads at least in their end section, onto which the nuts are screwed that form the anchor wings, whereby the one-sided screwing position of the nut is blocked.

SUMMARY OF THE INVENTION

It is an object of the present invention to provide an installation channel, a method for embedding an installation channel, and a structure in which a potential fault block is large so that large forces can be absorbed by the installation channel.

The present invention provides an installation channel to be embedded into a curable construction material, e.g. concrete, having a support profile and preferably a means for attaching at least one add-on part to the installation channel, so that the outside of the support profile has a direct connection to the curable construction material at an embedding area, whereby a preferably compressible insert is fastened to the outside of the support profile at the embedding area, so that part of the outside of the support profile is not in direct contact with the curable construction material at the embedding area.

The compressible, preferably elastic insert essentially prevents the transmission of forces from the support profile to the concrete in the area of the insert. Here, the insert is preferably arranged on an end section of the support profile in the vicinity of the outer area, so that as a result, the forces that are to be conveyed into the construction material, especially transverse forces, can be conveyed outside of the surface of the construction material into the curable construction material in deeper layers. Consequently, a resultant force from the forces conveyed into the installation channel enters into deeper layers of the construction material, so that a fault block with a larger volume can be achieved and consequently larger forces, especially transverse forces, can be conveyed into the installation channel, without this leading to a failure or fracture of the curable construction material.

In another embodiment, the curable construction material is mortar or preferably a mineral aggregate, e.g. gravel or sand, with a binder, e.g. cement or bitumen.

In another embodiment, the insert ends at the top on an outer area of the installation channel or at a distance of less than 5 cm, 3 cm or 1 cm from the outer area of the installation channel. As a result, the forces absorbed by the installation channel in the concrete are essentially conveyed into deeper layers of the construction material, so that consequently a resultant force from the forces absorbed by the installation channel enters essentially into deeper layers of the construction material, thus leading to a larger fault block.

In particular, the insert is cohesively fastened to the support profile, especially by means of an adhesive, and/or the insert is made up of several parts.

In another embodiment, the insert is configured at the embedding area (6) only partially on the outside of the support profile (2), so that only part of the support profile is not in direct contact with the curable construction material.

In a supplementary embodiment, the insert is configured only partially or else completely continuously in the direction of the longitudinal axis of the installation channel, and/or the insert is configured only partially or else completely continuously, namely, perpendicular to the longitudinal axis of the installation channel, and/or the embedding area has a connection in a direction parallel to the longitudinal axis and no connection to the curable construction material, and/or the embedding area has a connection in a direction perpendicular to the longitudinal axis and no connection to the curable construction material.

Preferably, the insert on the outside of the embedding area of the installation channel has the shape of a strip.

In one variant, the insert is made at least partially, especially completely, of foam, of STYROFOAM (extruded polystyrene foam), or of a woven fabric, especially of a synthetic material.

Advantageously, the cross section of the support profile is configured to be essentially C-shaped, and/or, in order for add-on parts to be attached, the means has at least one bolt or screw, for example, a T-head screw, a groove, a slit or a cavity that is enclosed by the support profile and that has an opening in the form of a groove or slit.

In another embodiment, the installation channel has at least one, preferably several, anchors to be embedded into the curable construction material, and preferably, the at least one anchor is attached to the support profile.

In particular, the at least one anchor is oriented essentially perpendicular to the axis of the insert that is configured as a strip and/or it is oriented perpendicular to the longitudinal axis of the installation channel.

In another embodiment, the support profile has one or two slanted legs that are oriented at an acute angle, especially at an angle between 20° and 70°, relative to a center plane, whereby the center plane is perpendicular to a plane generated by the opening, and preferably, it intersects the longitudinal axis of the installation channel. Due to the inclined slanted legs, the load absorbed by the installation channel can be conveyed into deeper layers of the construction material, so that a further enlargement of the fault block is associated with this and consequently, the loads or forces, especially transverse forces, that can be absorbed by the installation channel can be further increased.

In a supplementary variant, the installation channel, especially the support profile, consists at least partially, especially completely, of metal, e.g. iron, steel or aluminum, and/or of a synthetic material.

A method according to the invention for embedding an installation channel—especially an installation channel as described in this patent application—into a curable construction material, e.g. concrete or mortar, comprises the following steps: arranging the installation channel with a support profile at the place where it is to be embedded, placing a curable construction material into a space delimited by formwork so that the support profile is connected to the curable construction material, and curing the construction material, whereby the construction material is placed into the space and preferably removed from the space in such a way that, on the outside of an embedding area for the support profile, the construction material is only partially, especially directly, connected to the support profile.

In another variant, before the installation channel is put into place, a preferably compressible insert is fastened at the embedding area for the support profile. Since the insert is fastened to the support profile, the construction material put in place does not come into direct contact with or create a direct connection to the support profile in the area of the insert. As a result, essentially no forces are conveyed into the construction material in the area of the inserts after the concrete has cured.

In another embodiment, before the construction material is put in place, fillers are positioned at the embedding area for the support profile, and these fillers are removed after the construction material has been put in place and/or cured, so that a recess is formed between the support profile and the construction material, and/or the construction material is partially removed in the area of the support profile after the construction material has been put in place and/or cured, so that a recess is formed between the support profile and the construction material, and/or the installation channel is arranged in such a way, especially so high at the place that is to be embedded that the embedding area for the support profile is only partially connected, especially only in a lower area, to the construction material after the construction material has been put in place.

The invention relates to a structure or component according to the invention, e.g. a wall or ceiling, of the structure made of a curable construction material with an installation channel embedded into the construction material, whereby the installation channel is configured as an installation channel of the type described in this patent application, and/or the structure or the component of the structure is produced with a method of the type described in this patent application.

BRIEF DESCRIPTION OF THE DRAWINGS

Below, embodiments of the invention will be described in greater detail with reference to the accompanying drawings. The following is shown.

DETAILED DESCRIPTION

Figure 1:
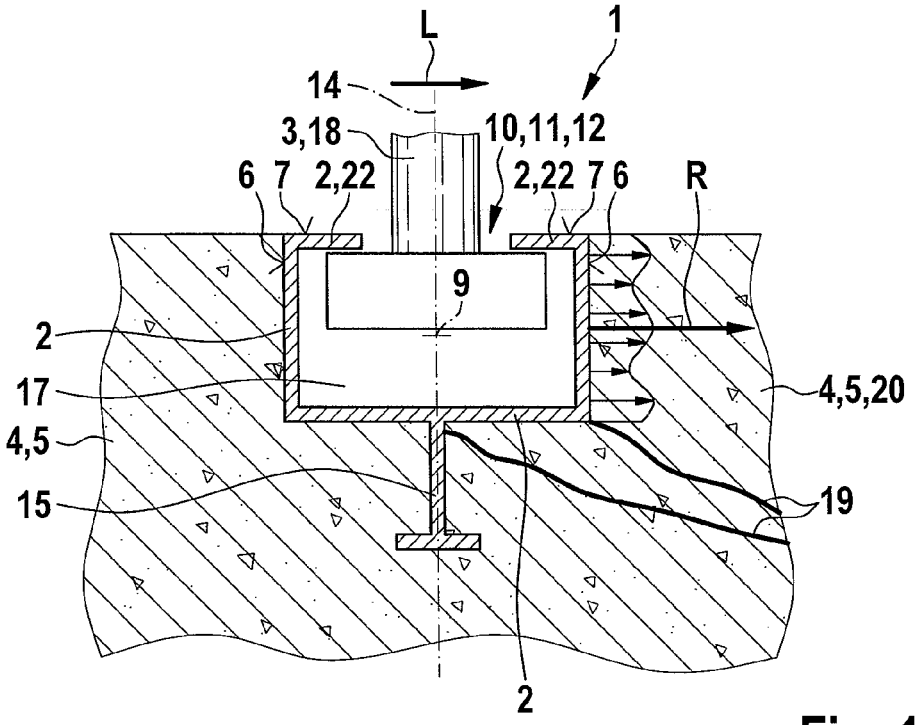
Fig. 1 (Prior Art)
FIG. 1 a cross section of an installation channel embedded into concrete, known from the state of the art, FIG. 2 a cross section of an installation channel embedded into concrete, in a first embodiment, FIG. 3 a cross section of the installation channel of FIG. 2, FIG. 4 a cross section of the installation channel in a second embodiment, FIG. 5 a side view of the installation channel of FIG. 3 or 4, FIG. 6 a side view of the installation channel of FIG. 3 or 4, FIG. 7 a cross section of the installation channel in a third embodiment, FIG. 8 a cross section of the installation channel in a fourth embodiment, FIG. 9 a cross section of the installation channel in a fifth embodiment, FIG. 10 a cross section of the installation channel embedded into concrete, with a recess at an embedding area, and FIG. 11 a cross section of the installation channel embedded into concrete, partially embedded into concrete at the embedding area.

FIG. 1 shows an installation channel 1 or anchor channel 1 known from the state of the art. The installation channel 1 consists of a support profile 2 made of metal, especially steel or aluminum. An anchor 15 is attached to a lower leg of the support profile 2, which is oriented horizontally in FIG. 1. In addition to the above-mentioned horizontally oriented leg of the support profile 2, the support profile 2 also has two vertically oriented legs. At the upper end of the vertically oriented legs of the support profile 2, there are two horizontally oriented strip legs 22. Here, the legs and the strip leg 22 of the support profile 2 are oriented essentially in a rectangular shape with respect to each other. On the outside, the lower essentially horizontally oriented leg and the two vertically oriented legs of the support profile 2 are directly connected to concrete 5 as the curable construction material 4 at an embedding area 6, for instance, as the wall of a structure. Thus, these legs create the embedding area 6 on the outside of the support profile 2. At the top 7, the two strip legs 22 are not connected to the concrete 5, i.e. they form an outer area 7 or a top area 7 of the support profile 2. The support profile 2 encloses a cavity 17. In the cavity 17, a hammerhead screw or a T-head screw 18 can be affixed as the means 3 for attaching add-on parts (not shown here).

In this manner, the installation channel 1 can absorb a load L, which is indicated by an arrow in FIG. 1. Here, the load L—as shown in FIG. 1—can be active in the horizontal direction; however, the load L can also be understood as a horizontal component of a load or force that is active at an angle of 0° to 90°. This leads to a resultant R as the resultant force in the concrete 5. Here, the resultant force R or the forces acting on the concrete 5 at the right-hand vertically oriented leg of the support profile 2 are conveyed into the concrete 5 at the upper concrete edge so that, due to the propagating fissures 19, a fault block 20 is created. Consequently, the installation channel 1 can convey only slight forces, especially transverse forces, into the concrete 5.

Figure 2:
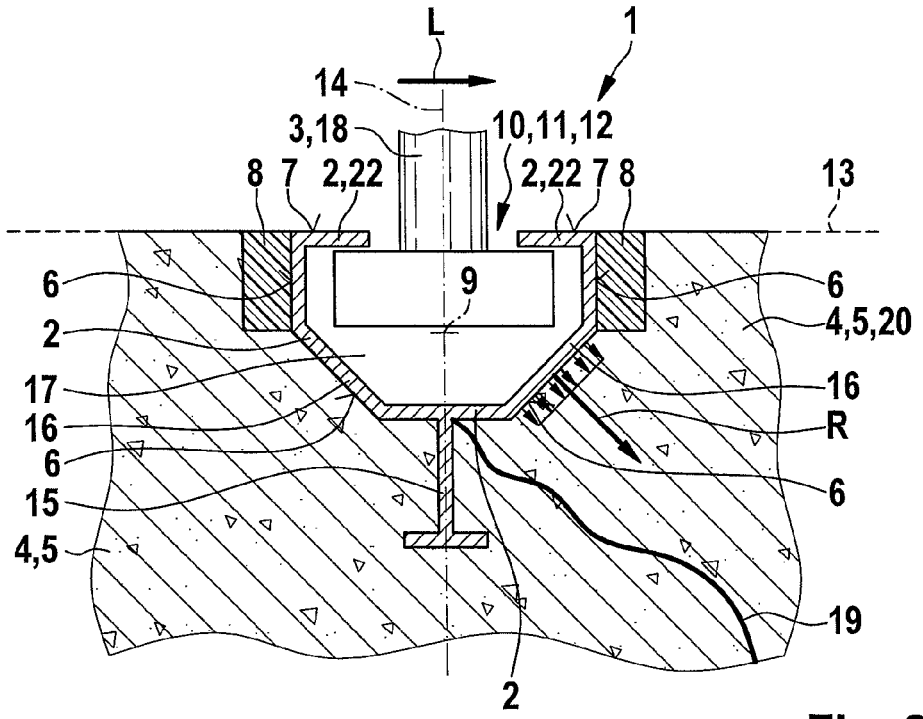
Figure 3:
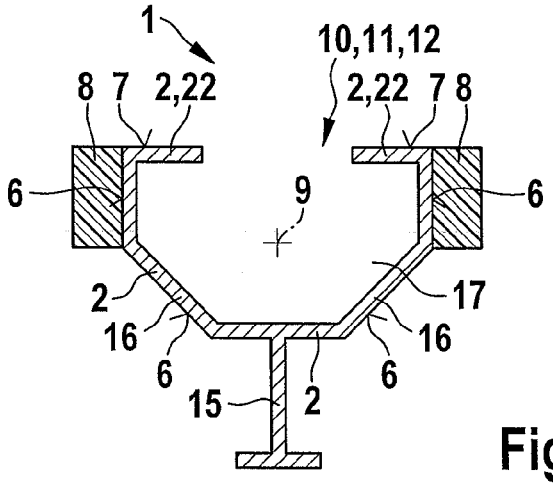
Figure 4:
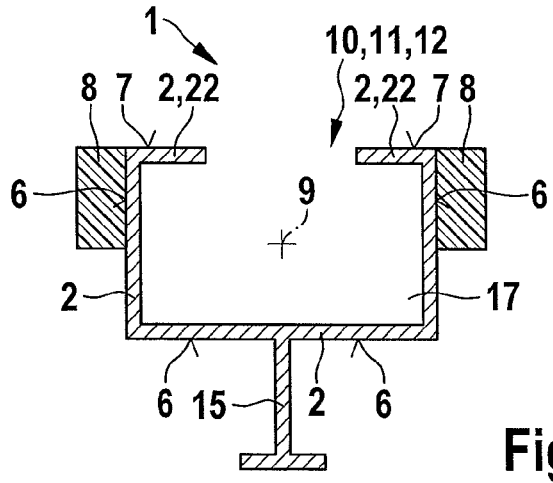
Figure 5:
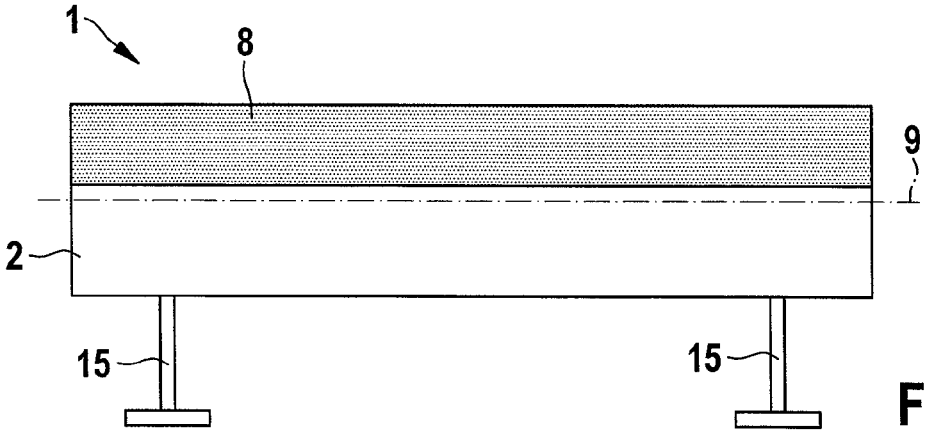

FIGS. 2 to 11 show an installation channel 1 according to the invention. The installation channel 1 shown in FIG. 2 and embedded into the concrete 5 is structured essentially like the installation channel 1 of FIG. 1, which is known from the state of the art, although the support profile 2 here now has a different geometry and moreover, compressible, preferably elastic, inserts 8 are fastened to the support profile 2. The support profile 2 has a horizontally oriented leg with anchors 15 arranged on it. These horizontally oriented legs of the support profile 2 are followed by two slanted legs 16 and, in turn, the slanted legs 16 are followed by two vertically oriented legs of the support profile 2. Analogously to the support profile 2 in FIG. 1, these two vertically oriented legs of the support profile 2 are followed by two strip legs 22 at the top 7 of the support profile 2. The compressible inserts 8 are glued onto the two vertically oriented legs on the outside of the support profile 2 at the embedding area 6. The inserts 8 are strip-shaped and, as strips of foamed material made of a synthetic material, they have a height of 0.5 mm to 10 mm, preferably 1.5 mm to 5 mm. The thickness of the insert 8 is especially within the range from 0.1 mm to 10 mm. Here, the length of the strip-shaped insert 8 matches the length of the support profile 2 (FIG. 5). Diverging from this, in terms of its lengthwise extension, that is to say, in an extension perpendicular to the drawing plane of FIG. 2, or in the direction of the longitudinal axis 9 of the installation channel 1 (FIG. 6), the insert 8 can also be present only over certain sections. When the load L is applied to the support profile 2 as a transverse force, due to the easy deformability of the insert 8, the support profile 2 conveys essentially no force into the concrete 5. As a result, the load L absorbed by the support profile 2 as the resultant force R is essentially conveyed into the concrete 5 by the inclined slanted leg 16. In contrast to the resultant force R in the state of the art according to FIG. 1, here, the resultant force R at the slanted leg 16 is not oriented horizontally but rather oriented downwards, so that, in the eventuality of a failure of the concrete 5, the fissures 19 do not run flat in the concrete either but rather obliquely at an angle of approximately 45° relative to the horizontal (FIG. 2). In this manner, the fracture surface, and thus the volume of the fault block, is enlarged, which leads to an increase in the pull-out force. Additional resultant forces R that act on the construction material 4 are not shown in FIG. 2, but this inevitably results in a closed force diagram, e.g. a force triangle, for a force equilibrium; this or these resultant force(s) R, which, for instance, the anchor 15 conveys into the construction material 4, however, have no effect on the size of the fault block 20. Thus, the fault block 20 of the concrete 5 increases in the eventuality of a failure, so that greater loads L can be absorbed by the support profile 2 due to the large fault block 20. The forces that the support profile 2 conveys into the concrete 5 as the resultant force R are thus essentially conveyed into lower layers of the concrete 5 obliquely below an area of the concrete 5 near the top. As a result, the fracture load of the concrete 5 can be increased and thus the total load-bearing capacity of the installation channel 1 can be enhanced.

The geometry of the support profile 2 of the installation channel 1 shown in FIG. 2 has an opening 12 between the two strip legs 22. The opening 12 generates an opening plane 13. The opening 12 is configured in the form of a groove 11 or in the form of a slit 10, and, perpendicular to the opening plane 13, there is a center plane 14 that also intersects the longitudinal axis 9 of the support profile 2. The longitudinal axis 9 of the support profile 2 or of the installation channel 1 is perpendicular to the drawing plane of FIG. 2. Here, the two slanted legs 16 are oriented at an angle of approximately 45° relative to the center plane 14.

At the embedding area 6, the concrete 5 is in direct contact with the support profile 2 at the lower vertically oriented leg of the support profile 2 and at the two slanted legs 16. At the upper vertically oriented leg of the support profile 2, there is no direct connection between the support profile 2 and the concrete 5 because the insert 8 is arranged between the support profile 2, that is to say, the vertical leg of the support profile 2, and the concrete 5.

Figure 6:
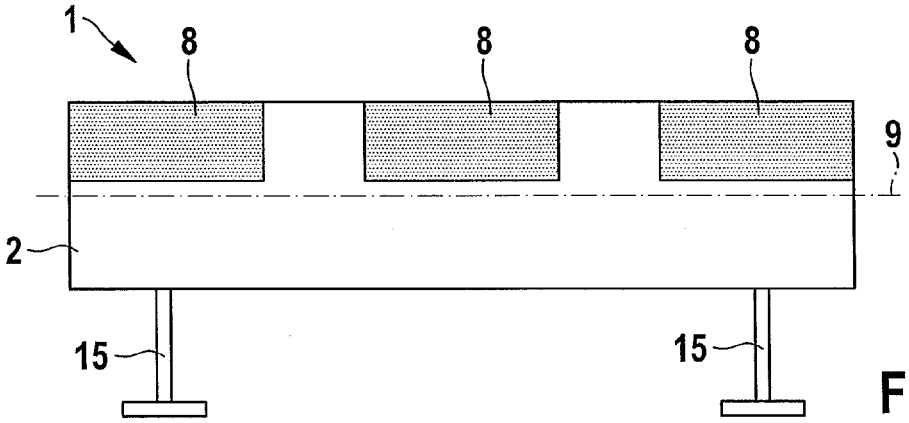

FIG. 3 shows the support profile 2 and the installation channel 1 of FIG. 2 without their being embedded into the concrete 5 and, in the same manner, FIG. 4 shows a second embodiment of the installation channel 1 without its being embedded into the concrete 5. FIGS. 5 and 6 show side views of the installation channel 1 according to the first embodiment of FIGS. 2 and 3 as well as according to the second embodiment of FIG. 4. The installation channels 1 shown in FIGS. 3 and 4 thus constitute a cross section perpendicular to the drawing plane of FIGS. 5 and 6. In the side views of the installation channel 1 shown in FIGS. 5 and 6, the strip-shaped insert 8 is configured as a completely continuous strip in FIG. 5, so that the length of the strip, as the insert 8, matches the length of the support profile 2, and thus the insert is configured so as to be completely continuous in the direction of the longitudinal axis 9 of the installation channel 1. In FIG. 6, the insert 8 is configured only in sections in the direction of the longitudinal axis 9 on the support profile 2, so that the insert 8 is only partially present in the direction of the longitudinal axis 9. Moreover, the insert 8 is only partially configured in a circumferential direction at the embedding area 6 of the support profile 2 or perpendicular to the longitudinal axis 9 of the installation channel 1 in FIGS. 5 and 6 or in FIGS. 3 and 4.

Figure 7:
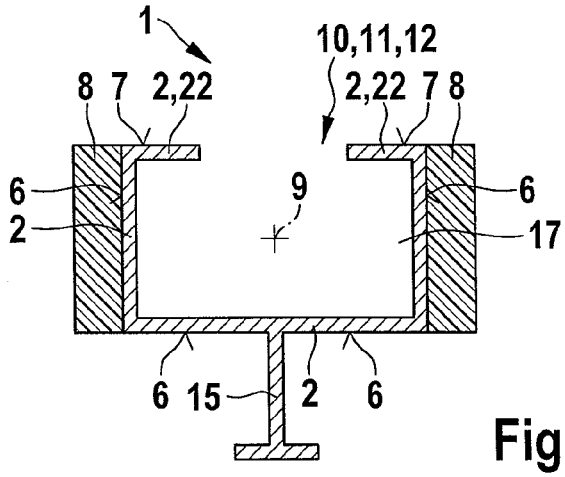

FIG. 7 shows the installation channel 1 in a third embodiment in a cross sectional view. Here, the geometry of the support profile 2 is configured so as to be essentially rectangular at the opening 12, with a lower horizontally oriented leg, two vertically oriented legs and two strip legs 22. The inserts 8 are fastened on the two vertically oriented legs of the support profile 2 on the outside at the embedding area 6 of the support profile 2. As far as the vertical leg of the support profile 2 is concerned, here the insert 8 is configured so as to be completely continuous on the vertical leg of the support profile 2 in a direction perpendicular to the longitudinal axis 9 of the installation channel 1.

Figure 8:
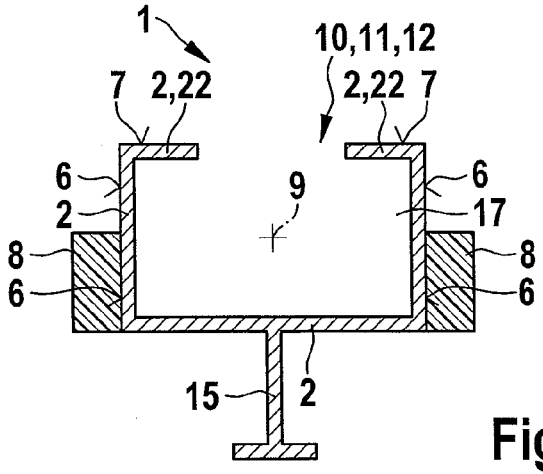

The fourth embodiment of the installation channel 1 shown in FIG. 8 differs from the third embodiment of FIG. 7 in that, on the two vertical legs of the support profile 2, the inserts 8 are only glued to the lower half of the vertical leg of the support profile 2. Thus, in the fourth embodiment, relative to the vertical legs of the support profile 2, the inserts 8 are only partially present perpendicular to the longitudinal axis 9 of the installation channel 1. The extension of the inserts 8 according to the third and fourth embodiments of the installation channel 1 shown in FIGS. 7 and 8 can be configured only partially or else completely continuously, namely, perpendicular to the drawing plane of FIG. 1, i.e. in a direction parallel to the longitudinal axis 9 of the installation channel 1, in other words, in a manner that is analogous to the configuration of the insert 8 in FIGS. 5 and 6.

Figure 9:
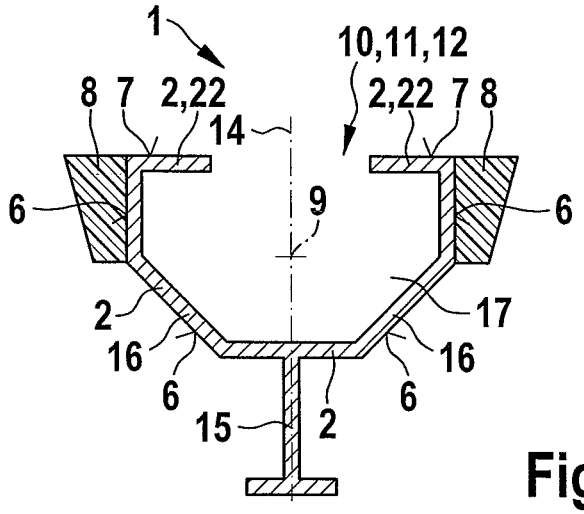

FIG. 9 shows a fifth embodiment of the installation channel 1. In the fifth embodiment of the installation channel 1 shown in FIG. 9, the insert 8 has a different thickness, so that the insert 8 ends with a wedge shape on the concrete 5. Here, the insert 8 has a greater thickness at the top 7 of the installation channel 1 than at the lower end of the insert 8 at the beginning of the slanted leg 16 of the support profile 2.

Figure 10:
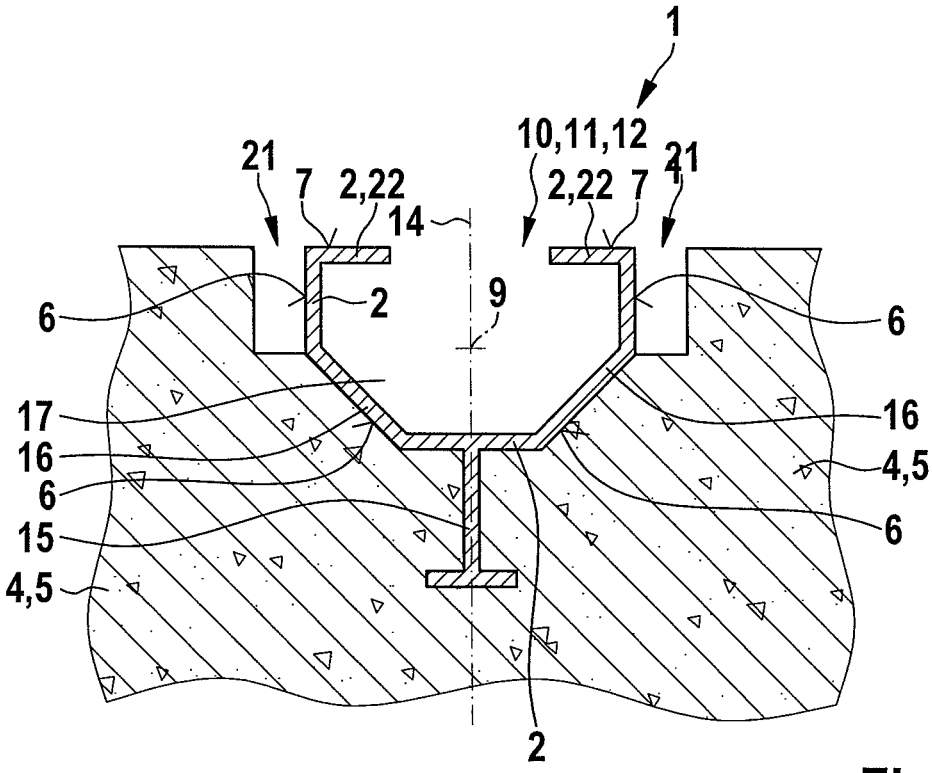

FIG. 10 shows a cross section of an installation channel 1 embedded into concrete 5, with the concrete 5 having a recess 21 at its top. When the structure is built with the installation channel 1 and with the curable construction material 4 as concrete 5, first of all, the installation channel 1 is arranged at the place that is to be embedded, for example, appropriately onto formwork. Subsequently, the concrete 5 is placed into the space surrounded by the formwork. After the concrete 5 has been put in place and after the associated connection of the concrete 5 to the entire embedding area 6 of the support profile 2, the concrete 5 is removed at the two vertically oriented legs of the support profile 2, so that the is strip-shaped recess 21 is formed and thus the two vertical legs of the support profile 2 are no longer connected to the concrete 5. The concrete 5 can be removed during or after the curing of the concrete 5. The concrete 5 can be taken away at the recesses 21, for example, by grinding with a diamond-tipped tool, with a milling tool, or by drilling, chiseling, or else by a combination of these methods. The width of the slit here is in the range between 0.5 mm and 20 mm, preferably in the range between 1.5 mm and 5 mm. The height of the slit, namely, the recess 21, matches the height of the vertical leg of the support profile 2. The extension of the recess 21 perpendicular to the drawing plane of FIG. 1 can be either completely continuous or else the recess 21 is configured only partially on the vertical leg of the support profile 2 perpendicular to the drawing plane of FIG. 10, that is to say, in a direction parallel to the longitudinal axis 9 of the support profile 2.

Diverging from the production method described above for the recess 21, the recess 21 can also be made in that, during the placement of the concrete 5, a filler (not shown here) is arranged on the two vertical legs of the support profile 2. Here, the filler can also be attached by an adhesive to the vertical leg of the support profile 2. After the concrete 5 has been put in place and after it has partially or completely cured, the filler (not shown here) is removed so that the strip-shaped recess 21 is once again present at the embedding area 6 of the support profile 2 in the vicinity of the two vertical legs. Thus, it can also be achieved that, on the support profile 2, in a manner that is analogous to that of the depiction in FIG. 2, the resultant force R from the load L is conveyed into deeper layers of the concrete 5 obliquely downwards into the concrete 5. This brings about a large fault block 20 and the installation channel 1 can absorb great loads L, especially transverse forces, when the installation channel 1 is integrated into the concrete 5 near the edge, in terms of the transverse forces.

Figure 11:
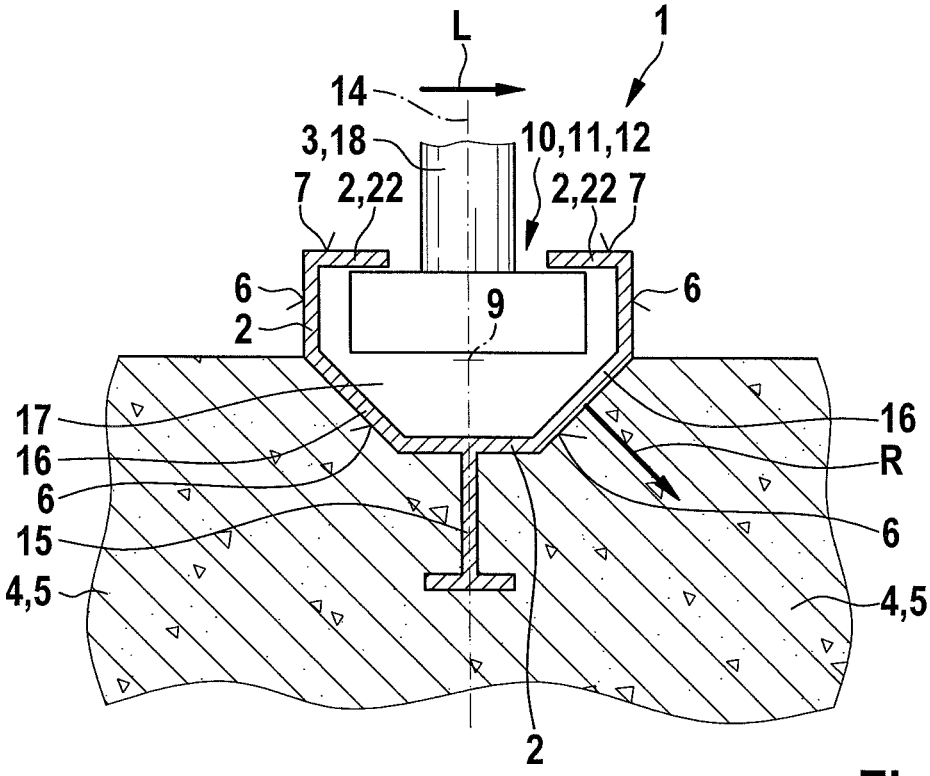

FIG. 11 shows another embodiment for embedding the installation channel 1 into the concrete 5. The installation channel 1 is embedded so high into the concrete 5 that the embedding area 6 of the support profile 2 is situated in the area of the two vertical legs of the support profile 2 outside of the concrete 5. Thus, only the two slanted legs 16 and the horizontally oriented leg of the support profile 2 are connected to the concrete 5. In this embodiment as well, it can be achieved that the resultant force R from the load L can be conveyed into the concrete 5 more sharply slanted downwards in the direction of deeper layers of the concrete 5, thereby bringing about a larger fault block 20.

Unless otherwise indicated and/or provided that it is feasible, the various embodiments can be combined with each other.

All in all, major advantages are associated with the installation channel 1 according to the invention. The forces conveyed into the construction material 4 as the resultant force R by the installation channel 1 with the support profile 2 due to the load L acting on the installation channel 1 are conveyed obliquely into deeper layers of the construction material 4 so that, as a result, a large fault block 20 can be achieved. Thus, the installation channel 1 can absorb greater forces as the load L. This is especially advantageous when the installation channel 1 is integrated into the construction material 4 on the edge with acting transverse forces as the load L. When the installation channel 1 is integrated at the edge, the construction material 4 has only a slight extension from the installation channel 1 in the direction of the transverse force or the load L toward the end of the construction material 4.

What is claimed is:

1. An installation channel to be embedded into a curable construction material comprising:

a support profile extending longitudinally and having a longitudinal opening for an attachment, the opening being wider than a part of the attachment in the longitudinal opening when the attachment is in an installed state in the support profile, an outside of the support profile having an embedding area, at least part of the embedding area for having a direct connection to the curable construction material; and an insert fastened to the outside of the support profile at the embedding area, so that part of the outside of the support profile is not for direct contact with the curable construction material at the embedding area, the insert being compressible and made of foam or of a woven fabric made of a synthetic material.

2. The installation channel as recited in claim 1 wherein the insert is adhesively fastened to the support profile and/or the insert is made up of several parts.

3. The installation channel as recited in claim 2 further comprising an adhesive between the insert and the support profile.

4. The installation channel as recited in claim 1 wherein the insert is configured at the embedding area only partially on the outside of the support profile, so that only part of the support profile is not for direct contact with the curable construction material.

5. The installation channel as recited in claim 4 wherein the insert is configured only partially or else completely continuously in a direction of the longitudinal axis of the installation channel, and/or the insert is configured only partially or else completely continuously perpendicular to the longitudinal axis of the installation channel, and/or the embedding area has a connection in a direction parallel to the longitudinal axis and no connection to the curable construction material, and/or the embedding area has a connection in a direction perpendicular to the longitudinal axis and no connection for the curable construction material.

6. The installation channel as recited in claim 1 wherein the insert on the outside of the embedding area of the installation channel has the shape of a strip.

7. The installation channel as recited in claim 1 wherein the insert is made of extruded polystyrene foam.

8. The installation channel as recited in claim 1 wherein a cross section of the support profile is configured to be C-shaped.

9. The installation channel as recited in claim 1 further comprising the attachment, the attachment being for add-on parts to be attached, the attachment including at least one of a bolt and a screw.

10. The installation channel as recited in claim 9 wherein the attachment is a T-shaped screw.

11. The installation channel as recited in claim 1 wherein further comprising at least one anchor to be embedded into the curable construction material.

12. The installation channel as recited in claim 11 wherein the at least one anchor is attached to the support profile.

13. The installation channel as recited in claim 11 wherein the at least one anchor includes a plurality of anchors.

14. The installation channel as recited in claim 11 wherein the at least one anchor is oriented perpendicular to a longitudinal axis of the installation channel.

15. The installation channel as recited in claim 1 wherein the support profile has one or two slanted legs oriented at an acute angle, relative to a center plane, the center plane being perpendicular to a plane generated by an opening in the support profile, the opening defining an attachment for an add-on part.

16. The installation channel as recited in claim 15 wherein the center plane intersects the longitudinal axis of the installation channel.

17. The installation channel as recited in claim 15 wherein the acute angle is between 20° and 70°.

18. The installation channel as recited in claim 1 wherein the installation channel includes metal or a synthetic material.

19. The installation channel as recited in claim 18 wherein the support profile includes metal or a synthetic material.

20. The installation channel as recited in claim 18 wherein the support profile consists of metal.

21. The installation channel as recited in claim 18 wherein the installation channel includes iron, steel or aluminum.

22. The installation channel as recited in claim 1 wherein the installation channel is a concrete-embeddable installation channel.

23. A structure or component of the structure comprising:

a curable construction material; and an installation channel as recited in claim 1 embedded into the construction material.

24. The structure or component as recited in claim 23 wherein the curable construction material is concrete.

25. A wall or a ceiling comprising:

a curable construction material; and an installation channel as recited in claim 1 embedded into the construction material.

26. The installation channel as recited in claim 1 wherein the support profile has two longitudinally extending surfaces and a longitudinally extending cavity connected to the opening, the two longitudinally extending surfaces defining the opening, and further comprising the attachment, the attachment being a screw or a bolt having a head in the cavity in the installed state and a body, the body having a diameter less than a width of the opening so that the screw body is spaced apart from the surfaces in the installed state.

27. The installation channel as recited in claim 26 wherein the screw or bolt is a hammerhead screw or T-head screw.

28. The installation channel as recited in claim 1 wherein the attachment is a hammerhead or T-head screw.

29. The installation channel as recited in claim 26 wherein the head of the screw or bolt can enter the cavity without forcing apart the surfaces from each other.

* * * * *